US005132713A

United States Patent [19]

Christy et al.

[11] Patent Number: 5,132,713

[45] Date of Patent: Jul. 21, 1992

[54] ION DEPOSITION WEB-FED PRINT ENGINE

[75] Inventors: Orrin Christy, North Tonawanda; David J. Holler, Grand Island; Mark A. Matheis, North Tonawanda; Paul J. Paroff, Kenmore; James R. Halliday, Lewiston, all of N.Y.

[73] Assignee: Moore Business Forms, Inc., Grand Island, N.Y.

[21] Appl. No.: 670,013

[22] Filed: Mar. 15, 1991

[51] Int. Cl.[5] ..... G01D 15/06; B41F 13/24

[52] U.S. Cl. ..... 346/159; 101/247

[58] Field of Search ..... 346/153.1, 159; 101/216, 247

[56] References Cited

U.S. PATENT DOCUMENTS 4,046,070 9/1977 Halley ..... 101/216
4,619,515 10/1986 Maczuszenko et al. ..... 355/3 R
4,673,956 6/1987 Kobayashi ..... 346/160
4,789,876 12/1988 Miyai et al. ..... 355/3 R
4,875,063 10/1989 Idenawa et al. ..... 346/153.1 X

*Primary Examiner*—George H. Miller, Jr.
*Attorney, Agent, or Firm*—Nixon & Vanderhye

[57] ABSTRACT

The ion deposition web-fed engine includes a first fixed frame, a second frame pivotally mounted to the first frame, a third frame carried by the second frame for pivotal movement therewith and for movement in a transverse direction relative to the first and second frames. The third frame carries a print unit including an image cylinder for cooperation with an impression cylinder carried by the first frame. For servicing purposes, the second frame is pivoted relative to the first frame to provide access to the paper web, impression cylinder and image cylinder. Upon closing the second frame onto the first frame, the image cylinder defines an open nip with the impression cylinder. The print unit is movable linearly toward the impression cylinder to close the nip into a print condition.

27 Claims, 9 Drawing Sheets

ION DEPOSITION WEB-FED PRINT ENGINE

BACKGROUND AND SUMMARY OF THE INVENTION

The present invention relates to an ion deposition web-fed print engine having novel and improved features facilitating operation and servicing of the print engine.

Ion deposition printers conventionally transpose or transform computer-generated signals, such as word processing signals, for image printing on a print medium, for example, paper. More particularly, an ion deposition print engine typically includes an image cylinder mounted in opposition to an impression cylinder with the print medium, i.e., a web of paper, passing between the image and impression cylinders. The image cylinder includes a dielectric layer which receives an electrostatic image from an ion cartridge. The cartridge is driven electronically from the computer or word processing system. The electrostatic image imposed on the image cylinder is contacted with toner from a supply. At the nip between the image and impression cylinders, the toner is transferred to the print medium, i.e., the paper, in the identical form of the electrostatic image on the image cylinder and fused to the medium. Further rotation of the image cylinder causes it to pass a multi-component cleaning station which physically removes solid particulate matter. The image cylinder finally passes under a discharge head which removes any residual electrostatic charge on the image cylinder surface, whereby a fresh electrostatic image may be placed on the dielectric layer by the ion cartridge. The process is then repeated with the same or different images.

The location and arrangement of the various parts of prior ion deposition print engines have, to a substantial extent, complicated servicing the engine. For example, frequently it has been difficult to expose the internal parts of the engine to maintenance personnel and procedures. Replacing component parts, cleaning various areas of the engine and replacing the paper web are typically difficult to achieve. There is also the necessity to maintain substantial pressure between the image and impression cylinders during operation to effect printing. Accordingly, servicing ion deposition print engines has remained a significant problem.

Additionally, problems in paper web handling have also been encountered during service and maintenance procedures. For example, during such procedures, the paper would oftentimes go slack through the print engine when the impression cylinder is disengaged relative to the image cylinder. Once maintenance procedures were completed, the slack paper may lose registration. Further, the design of prior print engines of this type may be damaged by debris caught in the web and transported into the nip between the image and impression cylinders. Additionally, accommodation for splices in paper is frequently difficult to achieve. For example, debris or splice sensors are often disposed in the engine. Most prior ion deposition print engines employ a heavy mass of parts which inhibit quick disengagement in the event debris and splices are sensed. Undesirably, this heavy mass of parts must also be moved for maintenance purposes. Further, substantial pressure is required between the image cylinder and impression cylinder and this must be maintained balanced across the entirety of the width of the print area during printing.

Additionally, many prior print engines of this type are limited in the width of paper which can be printed. That is, in most print engines, the image cylinder and impression cylinder are not movable and can handle only a single predetermined maximum width of paper.

In accordance with the present invention, there is provided a novel and improved ion deposition web-fed print engine which vastly facilitates servicing of the print engine, enables printing on substantially wider widths of paper webs while maintaining the necessary force to achieve proper toner transfer, enables print at any lateral position across the paper webs by providing for movement of the image cylinder and impression cylinder in the cross-paper width direction, preferably a synchronized movement, enables servicing without removal or slackening of the paper web, reduces the number of movable parts necessary to both engage and disengage the paper between the image cylinder and impression cylinder and, hence, the mass of parts required for quick disengagement in the event of debris entering or the sensing of a splice between the image and impression cylinders, affords greater control and uniformity of the forces acting between the image cylinder and impression cylinder and affords various other advantages in construction, operation and use, and particularly during servicing.

Particularly, the present invention provides a first, fixed or stationary, base frame having an impression cylinder carried between end plates of the frame for carrying the print medium in web form. The impression cylinder is carried for transverse movement relative to the base frame, i.e., movement in a direction parallel to the axis of the impression cylinder.

A second frame is carried by the first frame for pivotal movement about a transversely extending axis, between print engine open and closed positions, i.e., between service and operating positions, respectively. A third frame is carried by the second frame for pivotal movement with the second frame and also for movement in a transverse direction relative to the first and second frames, i.e., a direction parallel to the axes of rotation of the image and impression cylinders. The third frame carries a print unit, including the image cylinder. Thus, the image cylinder is movable with the second frame between the print engine closed and open positions and, with the third frame, in a transverse direction. The transverse movement of both the impression cylinder and the image cylinder is accomplished by a series of lead screws connected between the end plates of the first frame. Thus, joint movement of the image cylinder and the impression cylinder is accomplished to ensure registration and printing in the proper area at any position across the entire width of the paper, should the width of the paper be larger than the axial extent of the image cylinder and impression cylinder.

The image cylinder is also carried by the third frame for linear movement in a direction toward and away from the impression cylinder. The image cylinder is mounted on linear bearings and maintained in a nip open position relative to the impression cylinder when the second frame is pivoted to the print engine closed position. Consequently, a small space at the nip is provided between the image cylinder and impression cylinder prior to operating the print engine. Fluid-actuated cylinders cooperate between the image cylinder and the third frame to displace the image cylinder toward and into engagement with the impression cylinder to apply substantial forces to the paper passing through the nip. Coil springs are used to return the image cylinder to the nip open position when the hydraulic pressure is removed.

In a preferred embodiment according to the present invention, there is provided a print engine comprising a first fixed frame, an impression cylinder carried by the fixed frame for carrying a medium for receiving print and defining an axis extending in a transverse direction, a second frame carried by the first frame for pivotal movement about an axis extending in the transverse direction between print engine open and closed positions and a third frame carried by the second frame for pivotal movement therewith and for movement in the transverse direction. Means are provided for moving the third frame relative to the first and second frames in the transverse direction. A print unit is carried by the third frame for pivotal and transverse movement therewith and for movement relative thereto in a direction generally normal to the transverse direction, the print unit including an image cylinder carried for movement therewith in the transverse and normal directions, the image cylinder defining an open nip with the impression cylinder when the second frame lies in the print engine closed position, with additional means for moving the image cylinder in the generally normal direction to close the nip between the image cylinder and the impression cylinder when the second frame lies in the print engine closed position.

In a further preferred embodiment according to the present invention, there is provided a print engine, comprising a first fixed frame, an impression cylinder carried by the first frame for carrying a medium for receiving print and defining an axis extending in a transverse direction, a frame carried for pivotal movement on the first frame, an image cylinder carried by the pivotal frame for pivotal movement therewith between a print engine open position wherein the image cylinder is spaced from the impression cylinder to enable access within the print engine and a print engine closed position wherein the image cylinder lies closely adjacent to but spaced from the impression cylinder to define an open nip with the impression cylinder. Means are carried by the pivotal frame for moving the image cylinder toward the impression cylinder to close the nip therebetween when the pivotal frame lies in the print engine closed position.

In a further preferred embodiment according to the present invention, there is provided a print engine comprising a first fixed frame, a rotatable impression cylinder carried by the fixed frame for carrying a medium for receiving print and defining a rotational axis extending in a transverse direction, a second frame carried by the first frame for pivotal movement about an axis extending in a transverse direction between print engine open and closed positions and a third frame carried by the second frame for pivotal movement therewith and for movement in the transverse direction. An element cooperable between the third frame and at least one of the first and second frames is provided for moving the third frame relative to at least one of the first and second frames in the transverse direction and a print unit is carried by the third frame for pivotal and transverse movement therewith and having an image cylinder defining a nip with the impression cylinder when the second frame lies in the print engine closed position.

In a further preferred embodiment according to the present invention, there is provided a print engine comprising a first fixed frame, a rotatable impression cylinder carried by the fixed frame for carrying a medium for receiving print and defining a first rotational axis extending in a transverse direction, a second frame carried by the first frame for pivotal movement about a second axis extending in a transverse direction and between print engine open and closed positions, a print unit carried by the second frame for pivotal movement therewith and including an image cylinder carried thereby for rotational movement about a third rotational axis extending in a transverse direction and spaced from the first and second rotational axes and a driving element carried by the first frame and a driven element carried by the second frame. Means are provided for interconnecting the driving element and the driven element for rotating the image cylinder about the third axis, the driving element and the driven element being located on the first frame and the second frame, respectively, with the interconnecting means maintaining a driving relation therebetween when the second frame lies in each print engine open and closed positions.

In a further preferred embodiment according to the present invention, there is provided a print engine comprising a first fixed frame, a rotatable impression cylinder carried by the fixed frame for carrying a medium for receiving print and defining a first rotational roller axis extending in a transverse direction, a second frame carried by the first frame for pivotal movement about a second axis extending in a transverse direction and between print engine open and closed positions, and a third frame carried by the second frame for pivotal movement therewith and for movement in a transverse direction. An image cylinder is carried by the third frame for pivotal movement therewith and for linear movement relative thereto in a direction generally parallel to the transverse direction, the image cylinder being rotatable about a third rotational axis extending in the transverse direction. Means rotatably coincident with the second axis are provided for driving the image cylinder about the third axis and means are carried by the first frame and engageable with the third frame for moving the third frame in the transverse direction.

Accordingly, it is a primary object of the present invention to provide a novel and improved ion deposition print engine having constructional features enabling significantly increased accessibility for servicing the engine with fewer parts to be moved for access and service, as well as other advantages, in comparison with prior ion deposition print engines.

These and further objects and advantages of the present invention will become more apparent upon reference to the following specification, appended claims and drawings.

BRIEF DESCRIPTION OF THE DRAWING FIGURES

Figure 4:
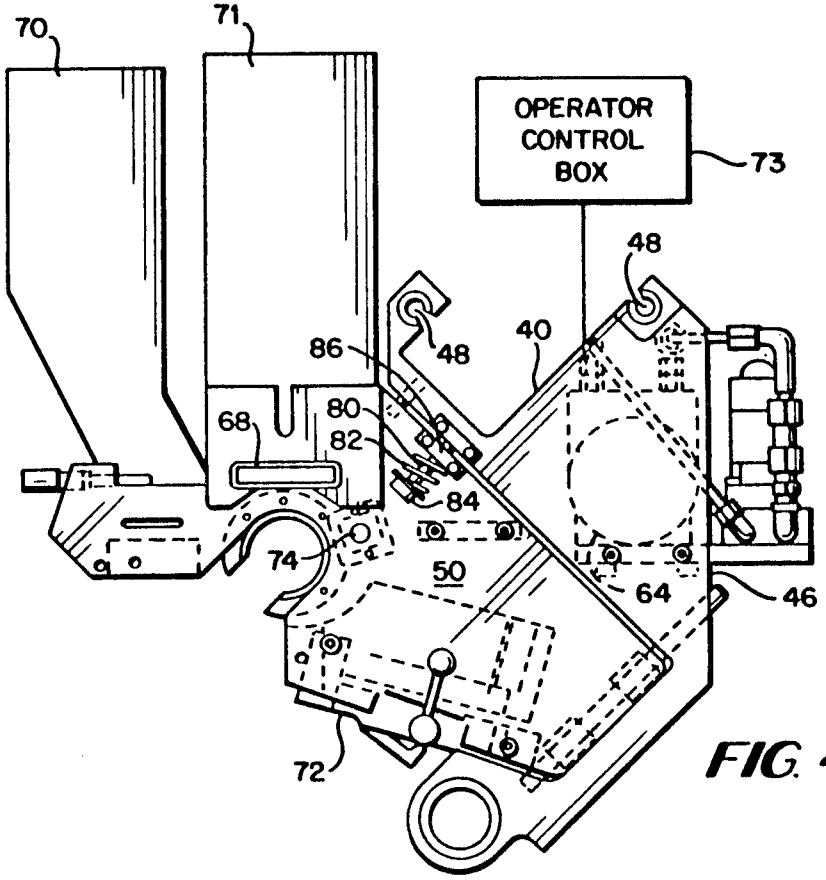
FIG. 4 is a side elevational view of the third frame supported by the pivotal frame illustrated in FIG. 3, likewise detached from the fixed frame.
Figure 5:
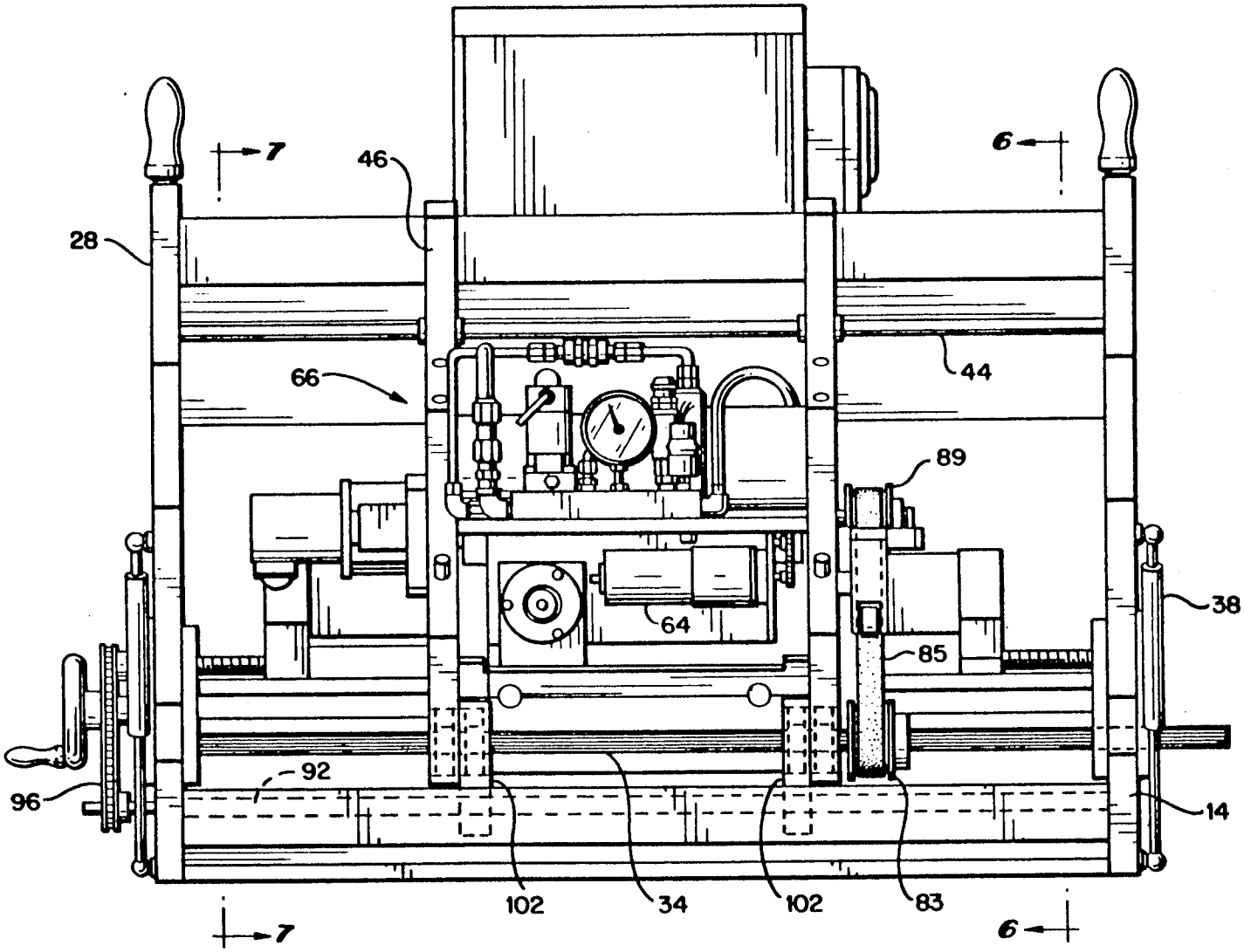
FIG. 5 is a rear elevational view of the ion print engine of FIG. 1 looking from right to left in each of drawing FIGS. 1 and 2.
Figure 6:
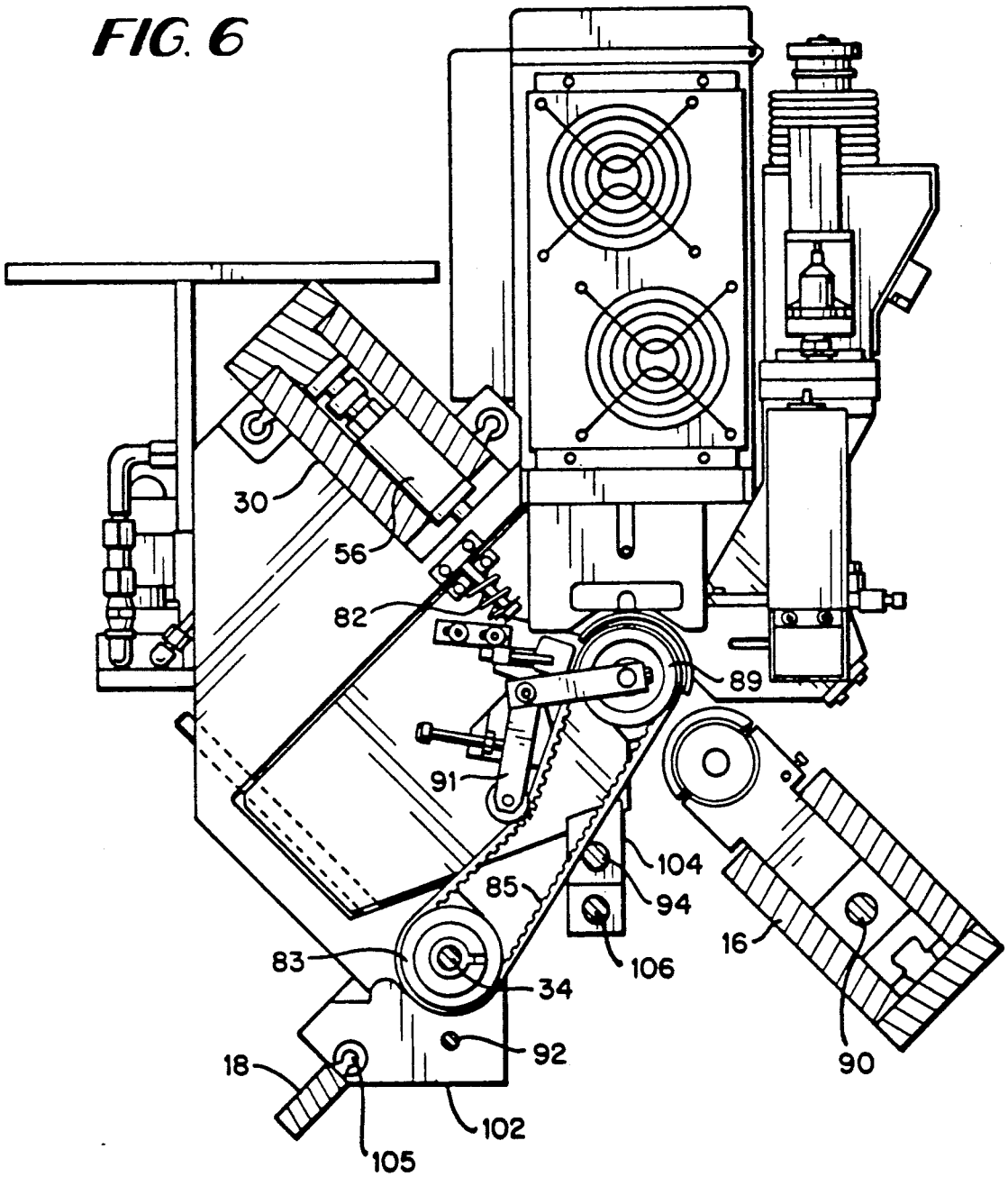
Figure 7:
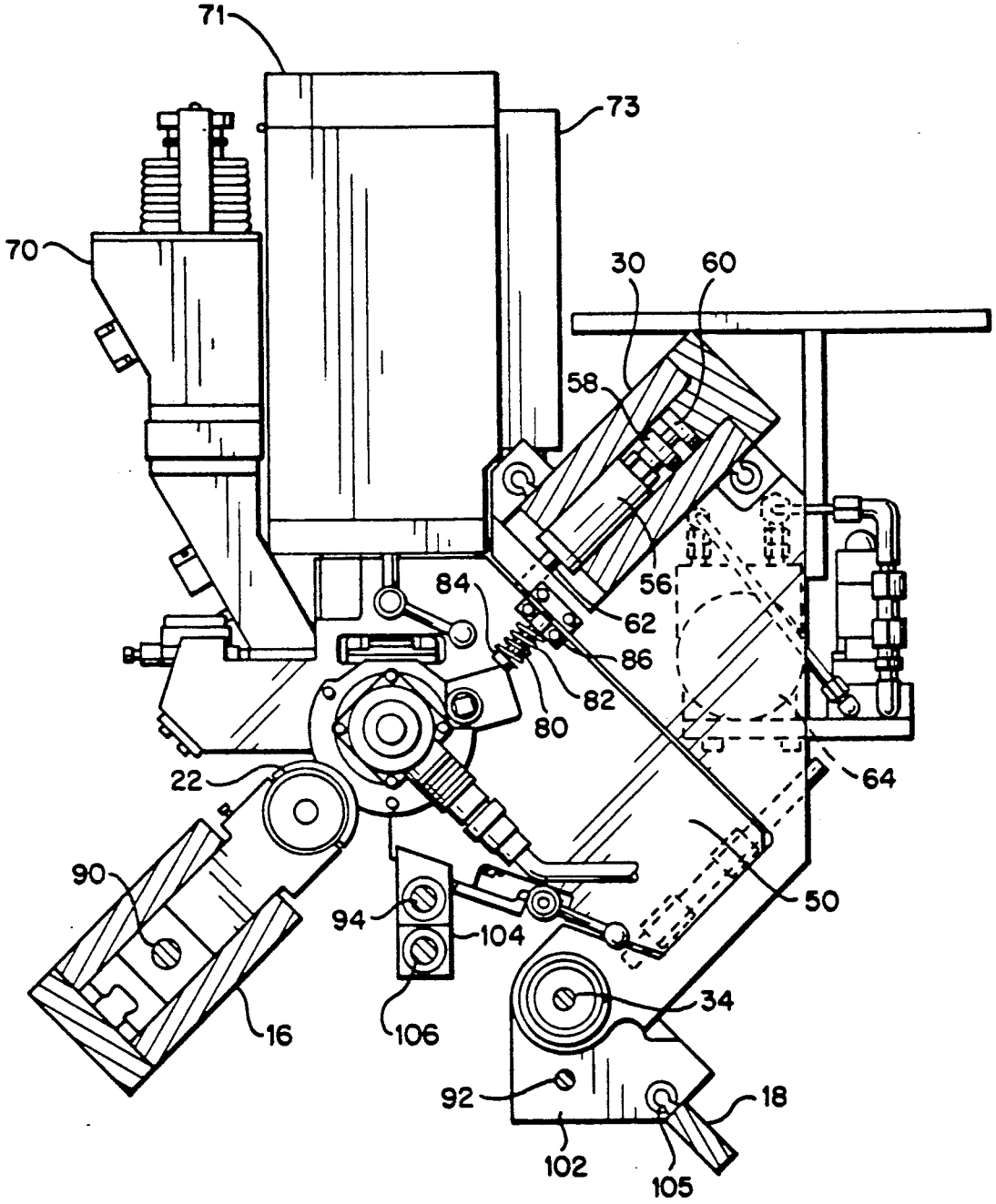
Figure 8:
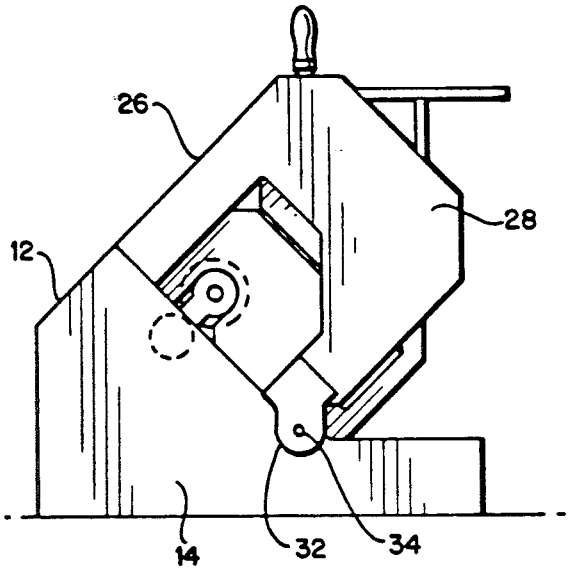
Figure 9:
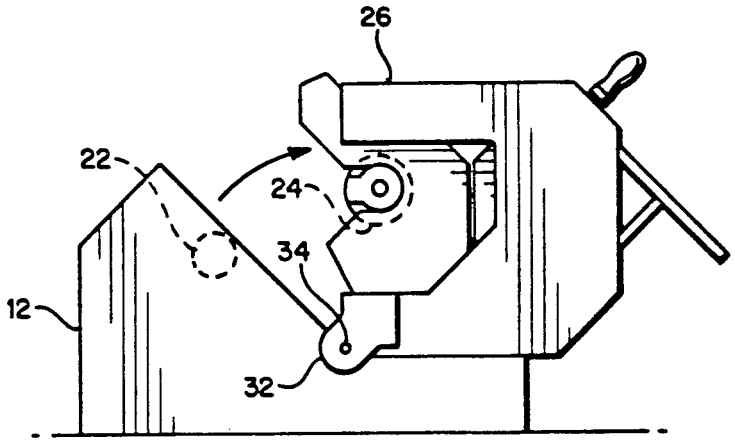
Figure 10:
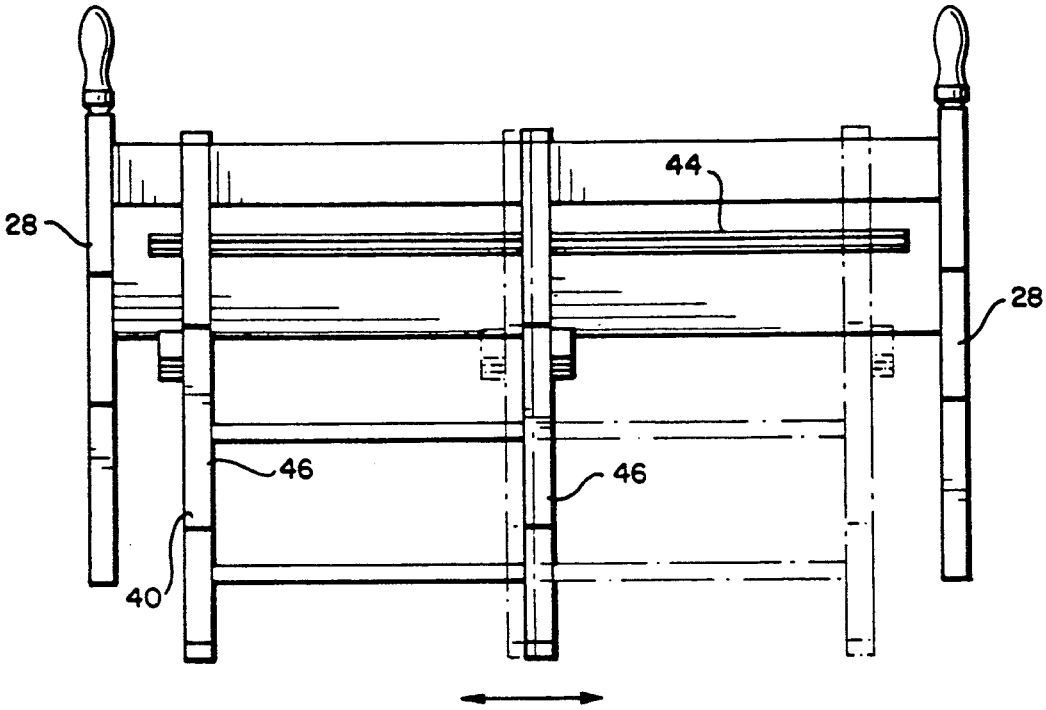
Figure 11:
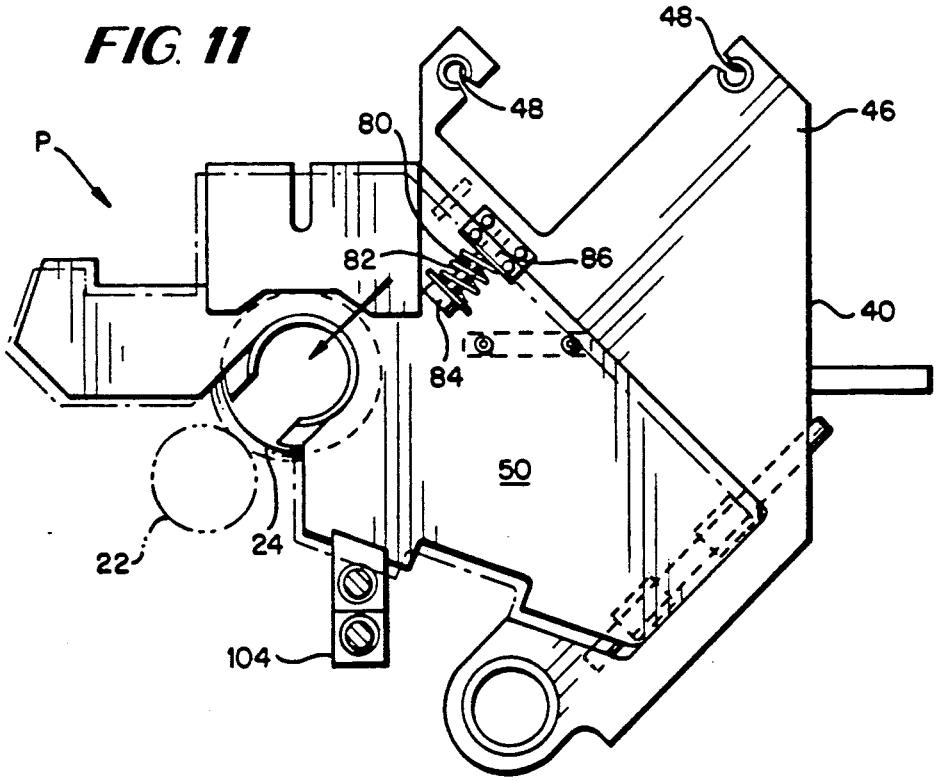
Figure 12:
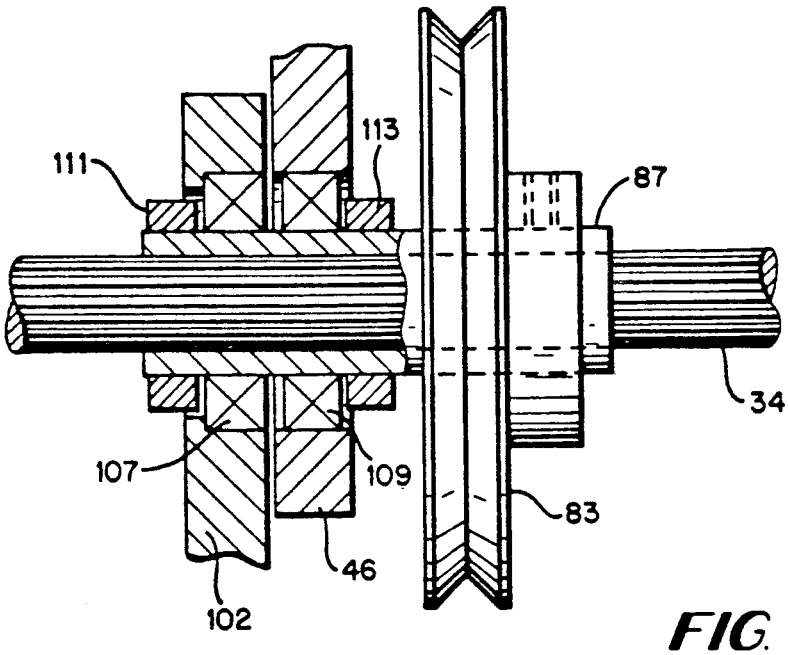
Figure 13:
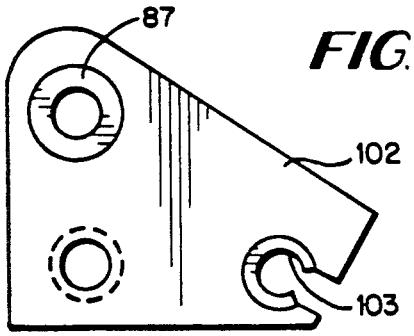

FIGS. 6 and 7 are cross-sectional views thereof taken generally about on lines 6—6 and 7—7 in FIG. 5, respectively, with portions not being illustrated for clarity;

FIGS. 8 and 9 are schematic illustrations of the print engine with the cover in the closed and open positions, respectively;

FIG. 10 is a schematic illustration of the second and third frames showing their relative movement; and FIG. 11 is a side elevational view similar to FIG. 4 illustrating the movement of the image cylinder toward and away from the impression cylinder;

FIG. 12 is an enlarged fragmentary cross-sectional view illustrating a lead screw, ear and driving belt pulley for the image cylinder;

FIG. 13 is a side elevational view of the ear illustrated in FIG. 12; and

Figure 14:
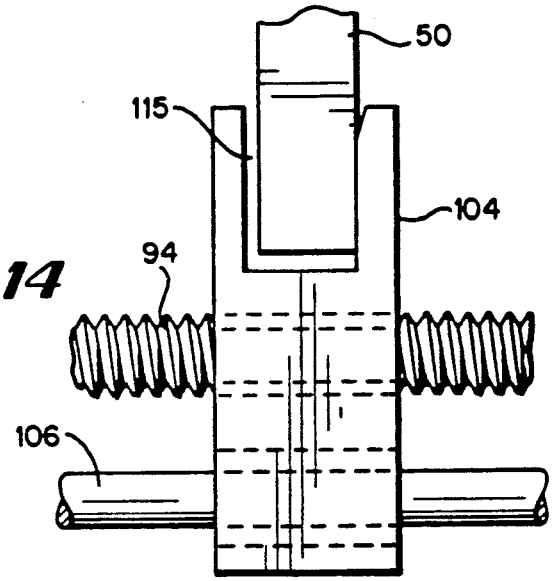

FIG. 14 is a fragmentary elevational view of stanchions driven by a lead screw to positions for receiving the transversely movable third frame.

DETAILED DESCRIPTION OF THE DRAWING FIGURES

Reference will now be made in detail to the present preferred embodiment of the invention, an example of which is illustrated in the accompanying drawings.

Figure 1:
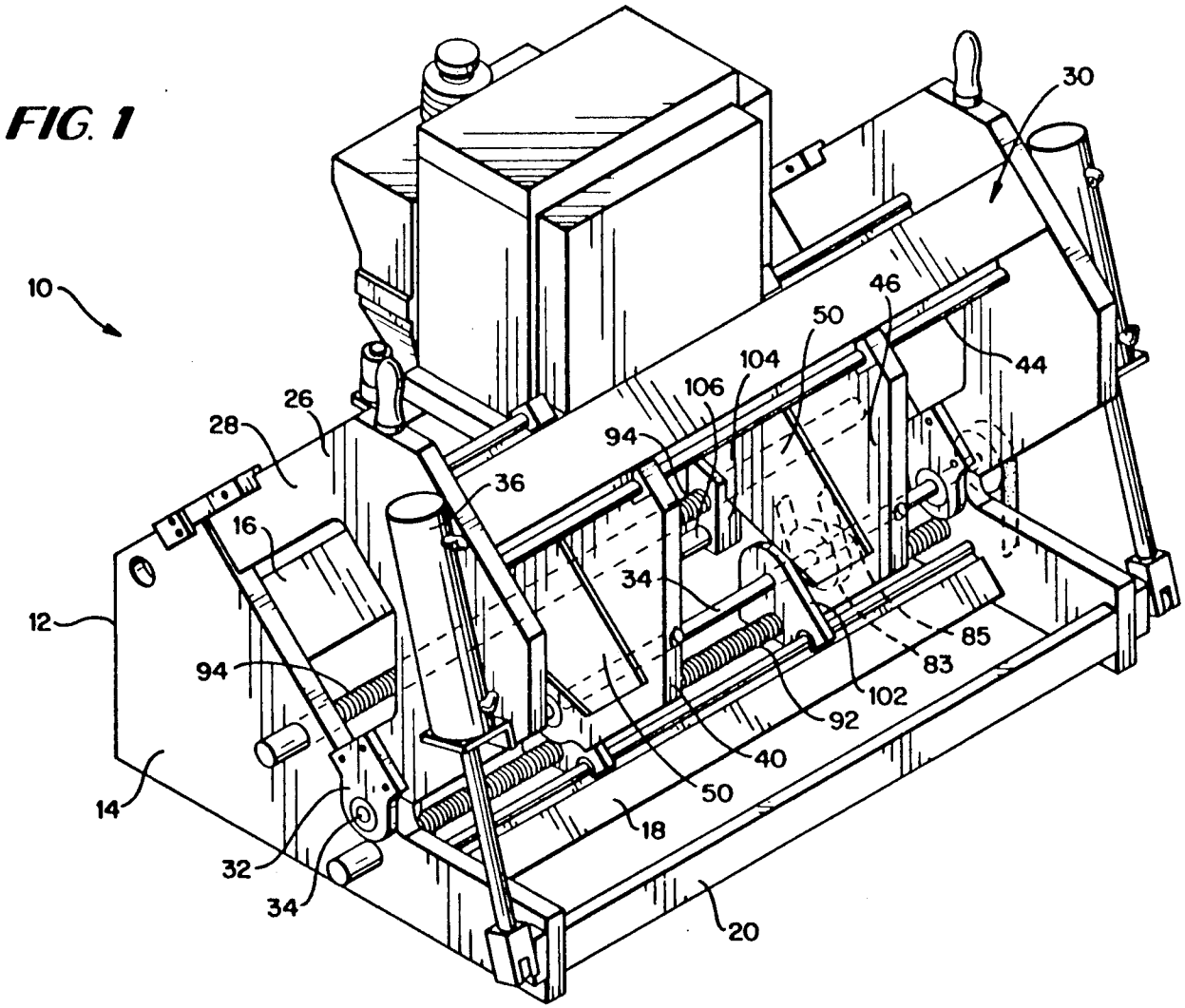
FIG. 1 is a perspective view of an ion print engine constructed in accordance with the present invention.

Referring now to FIGS. 1, 8 and 9, there is illustrated an ion deposition web-fed print engine constructed in accordance with the present invention and generally designated 10. Engine 10 includes a first fixed base frame 12 which forms the structural foundation of print engine 10 and mounts to the paper transport structure. Particularly, first frame 12 includes a pair of end frame plates 14 secured in transversely spaced relation one to the other by a lower impression cylinder assembly crossing beam 16 (FIGS. 1 and 2), an inner fixed frame guide beam 18 (FIGS. 1 and 2) and a tie bar 20. It will be appreciated that frame 12 forms part of a paper web transport (press, collector, etc.), the continuous paper web W of which being illustrated in FIG. 2 by the dashed line. As illustrated, it will be appreciated that paper web W passes over an impression cylinder 22 which cooperates with an image cylinder 24 carried by second and third frames of the engine which will now be described.

A second frame 26 comprises a pair of end plates 28 transversely spaced one from the other by various transversely extending elements, including a print unit crossing beam 30. The end plates 28 of second frame 26 overlie the end plates 14 of first frame 12. End plates 28 have depending ears 32 which receive the opposite ends of a transversely extending shaft 34. Second frame 26 is pivotal about the axis of shaft 34 between print engine closed and print engine opened positions, illustrated in FIGS. 8 and 9, respectively, and also by the full and dashed lines in FIG. 2. Pneumatically operated cylinders 36 are coupled between first and second end plates 14 and 26, respectively, at opposite ends of the engine, to rotate the second frame 26 between the print engine closed and opened positions. Gas springs 38 (FIG. 2) are also pivotally mounted between these two frames to create a counteracting force when the second frame is rotated and the center of gravity shifts. The gas springs are desirable because of the mass of the components held by the second frame 26.

Referring now to FIGS. 1 and 10, a third transversely movable frame 40 is mounted on the second frame 26 for pivoting movement with frame 26 between print engine closed and opened positions. More particularly, linear bearing tracks or shafts 44 are carried by the cross-beam 30 of second frame 26 and provide tracks to enable the third frame 40 to traverse between the end plates 28 of second frame 26. Thus, third frame 40 includes a pair of end plates 46 (FIGS. 4 and 11) having recesses 48 for engaging the tracks 44, enabling third frame 40 to pivot with the second frame 26 between print engine closed and opened positions and traverse between end plates 28 of second frame 26. As best illustrated in FIG. 11, a print unit P is carried between end plates 50 by third frame 40 for linear movement in a direction toward and away from the impression cylinder 22. Print unit P is mounted on linear tracks and is linearly displaced by multiple hydraulic cylinders 56 (FIGS. 2, 6 and 7), which are mounted on linear bearings 58 supported by a linear race 60 mounted within the print unit crossing beam 30. The extension rods 62 of the cylinders 56 provide the force for displacing print unit P toward impression cylinder 22. The hydraulic supply for cylinders 56 is provided by an electrically driven hydraulic pump 64 (FIG. 3) and a pressure control system, generally designated 66 (FIG. 5), is carried by the third frame 40.

The print unit P mounted within the end plates 46 of the third frame 40 for transverse and pivotal movement therewith also carries the image cylinder 24. Ancillary to the image cylinder for printing on the web, and as illustrated in FIG. 4, is an ion imaging device 68, a toner delivery and application system 70, drive electronics 71, a cylinder cleaning system 72, an operator control box 73 and an erasure assembly 74. These latter components are per se conventional and need not be described in detail. A pin 80 (FIGS. 4 and 11) projects from the third frame 40 and a coil spring 82 interconnects the head 84 of pin 80 and an abutment 86 on the print unit 50. The print unit P, including image cylinder 24 is thus biased for return linear movement in a direction away from the impression cylinder 22, i.e., a movement opposite to the movement of the print unit when hydraulic fluid is supplied to the hydraulic cylinders 56.

Referring now particularly to FIGS. 1, 5, 6 and 12, shaft 34 is splined and serves as a drive for translating power delivered from the paper transport mechanism, not shown, outside the frame 14 via splined shaft 34 to the image cylinder 24. To accomplish this, a timing pulley and belt, 83 and 85, respectively (FIGS. 1 and 6, are coupled to splined shaft 34 by a splined bushing 87 (FIG. 12). Timing belt 85 is coupled by a pulley 89 (FIGS. 5 and 6) on the image cylinder axis to the image cylinder 24. Suitable tensioning mechanisms 91 are provided for tensioning the timing belt 85. It will be appreciated that, because the axis of splined shaft 34 is located coincident with the axis of rotation of the second frame 26 relative to the first frame 12 (see FIGS. 8 and 9), the drive connection between the image cylinder 24 and the press drive, i.e., the drive from the paper transport mechanism, remains connected during servicing and movements of the second frame between open and closed positions relative to the first frame.

Figure 2:
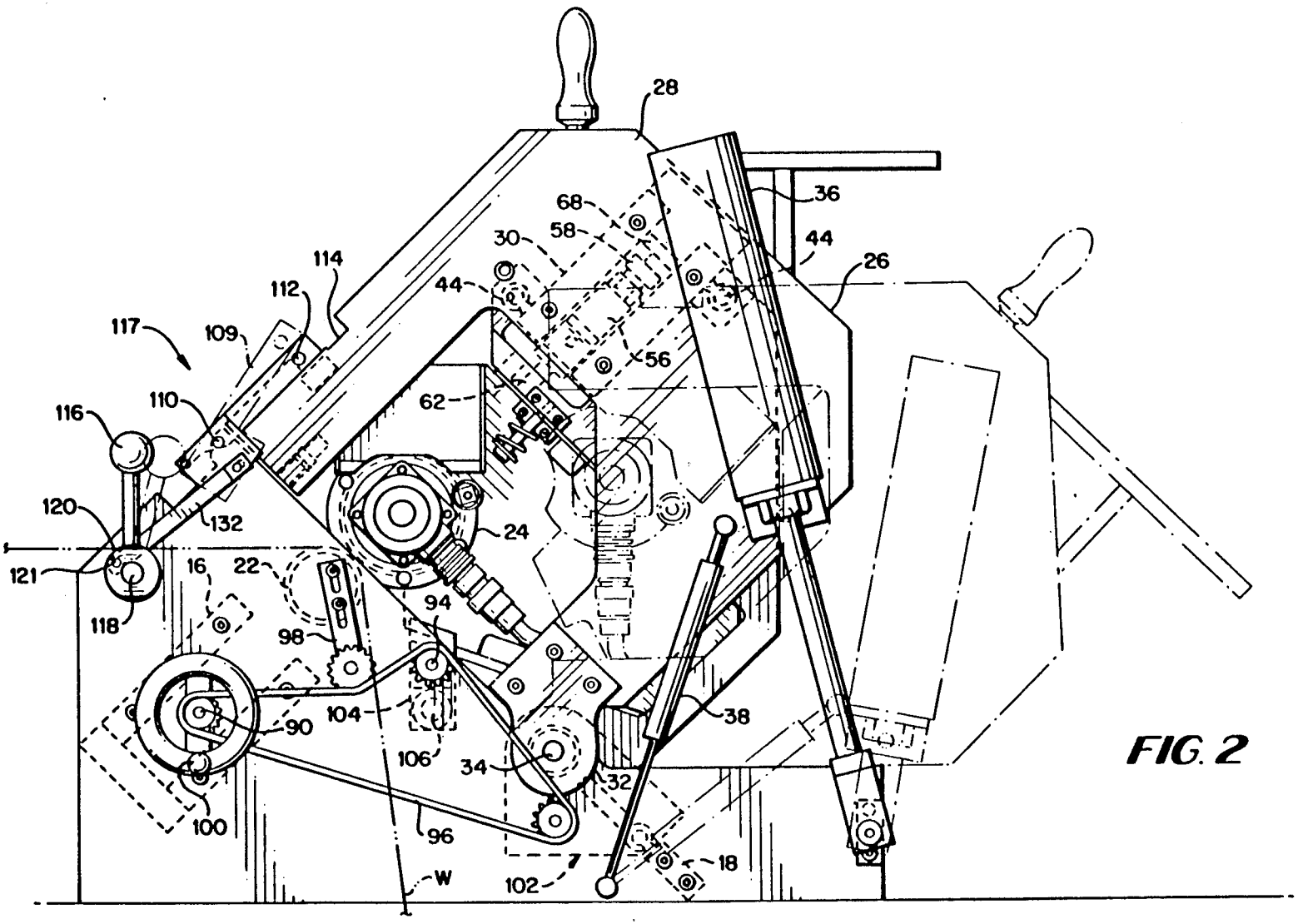
FIG. 2 is a side elevational view thereof.
Figure 3:
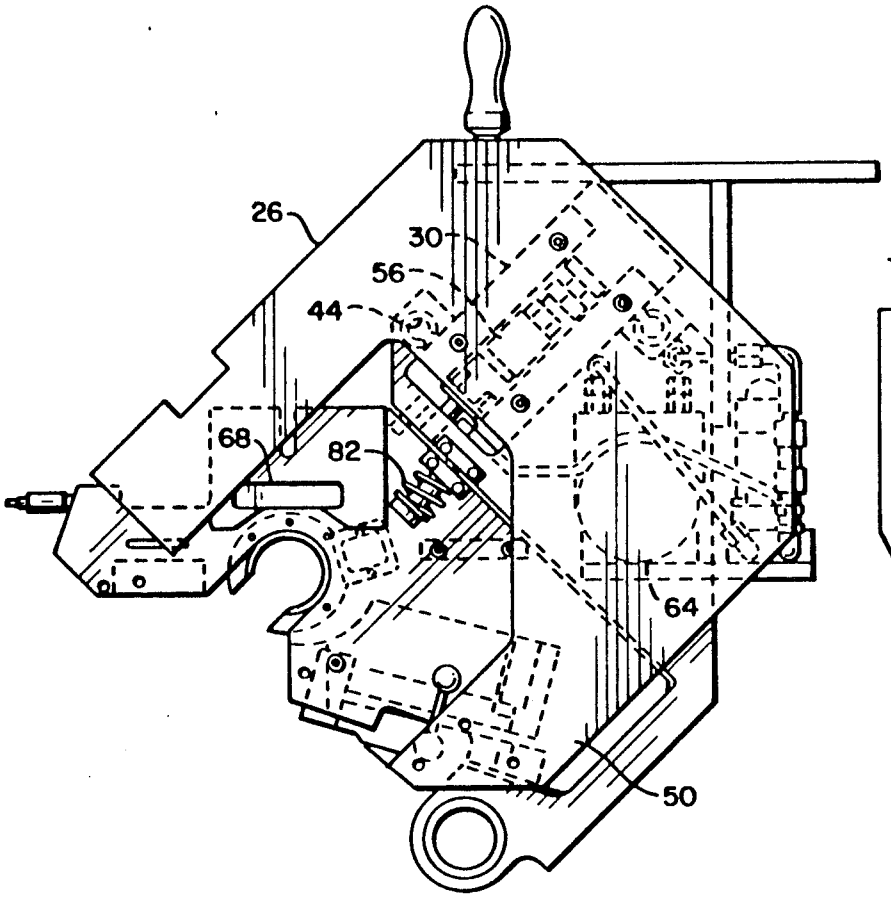
FIG. 3 is a side elevational view of the pivotal cover and related parts detached from the fixed frame.

Referring now to FIGS. 1, 2 and 10, it will be appreciated that the third frame 40 is carried for linear transverse movement by the second frame 26. To accomplish this, a manually operated traversing mechanism is provided, including three lead screws 90, 92 and 94 carried by the first frame 12 and interconnected by a drive chain 96 (FIGS. 1 and 7). A tensioner mechanism 98 tensions the chain 96. A hand crank 100 is provided on lead screw 90 whereby the three lead screws may be driven in synchronization via chain 96. The image cylinder 24 and print unit P including impression cylinder 22 are mounted for transverse movement across the width of the print engine between the end frames 14 by rotation of lead screws 90 and 92, respectively. More particularly, lead screw 92 carries a pair of transversely spaced ears 102 for linear transverse movement in response to rotation of lead screw 92. Ears 102 are located inside the end plates 46 of third frame 40. Each ear carries a bearing 103 (FIG. 13) which rides on a transversely extending linear bearing 105 (FIGS. 6 and 7) carried on stabilizer bar 18. Ears 102 remain with the first frame 12 upon rotation of the second and third frames 26 and 40, respectively, between the open and closed positions illustrated in FIGS. 8 and 9. As illustrated in FIGS. 12 and 13, the ears 102 receive the splined bushing 87 which, in turn, receives the splined shaft 34. Bearings 107*a*and 107*b* are provided in the openings in ears 102 and third frame end plates 46, respectively, whereby splined shaft 34 may rotate without rotating ears 102 or frames 46. Additionally, locking collars 111 and 113, respectively, are provided on splined bushing 87 on opposite sides of each paired ear 102 and frame 46 whereby ears 102 and frames 46 will translate in a transverse direction without rotation in response to rotation of splined shaft 34. Thus, when the ears 102 are driven transversely across the paper web direction by lead screw 92, the frames 46 carrying the print unit P are transversely moved with ears 102. The bearings 107*a* and 107*b*, of course, enable continuous rotation of the splined shaft 34 for rotating image cylinder 24. The ears 102 enable the frame 40 to traverse the width of the print engine between the end plates 14 of base frame 12 and also allows this assembly to pivot with second frame 26 between print engine open and closed positions about pivot 34.

Lead screw 94 also engages support stanchions 104 (FIGS. 2, 6, 7 and 14) to enable the print unit to have additional cross-support when the third frame 40 is displaced. The stanchions 104 are guided in this motion and supported by rod 106. Each stanchion 104 has an upper slot 115 (FIG. 14) for receiving the lower edge of the end plates 50 supporting the print unit P. Thus, when the frames 26 and 40 are raised relative to frame 12 (FIG. 9) and returned (FIG. 8), the slots 115 receive the lower edge of plates 50 to stabilize the print unit P.

A follower, not shown, is also carried on transversely extending linear bearings on crossing beam 16. The follower is coupled to the transversely movable impression cylinder 22. Thus, by rotating lead screw 90, the impression cylinder 22 is movable transversely across frame 14.

The motion of the three followers on the lead screws is synchronous via the timing chain 96 and therefore enables the third frame and print unit to traverse the print assembly between the opposing outer end plates of the first and second frames and simultaneously the impression cylinder 22 to traverse the print engine between end frames 14 whereby the print engine may remain closed during transverse adjustment of the image and impression cylinders. This enables the print unit to print at varying positions across a wide web of paper and permits the operator to make small adjustments to the cross-web registration of the printing on the web. Further, by the synchronous drive, the image cylinder and the impression cylinder are maintained directly opposed to one another with the image cylinder being centered by the stanchions 104. This transverse motion may be effected in both the open and closed positions. If transverse motion is desired in the locked printing position, the paper web W must be running through the print engine to avoid tearing or ripping the web.

Because of the high pressures involved when engaging the image cylinder against the impression cylinder, the pivotal frame and main frame are locked one to the other in the print engine closed position. Particularly, and referring to FIG. 2, there is provided a locking mechanism 117 for locking the first and second frames one to the other in the print engine closed position. Locking mechanism 117 includes pivotal bars 109 pivoted about pivots 110. When in the locking condition, locking rods 112 carried by bars 109 engage in locking notches 114 on the end frames 28. To pivot the locking bars into the locked position, a hand-driven mechanism is provided and includes a handle 116 for applying a rotational force to a shaft 118 for pivoting on the fixed end plates 14. A cam mechanism 120 is provided including a cam 121 on shaft 118. By rotating cam 121, link 132 rotates bar 109 about pivot 110 and moves it into the locking position with rod 112 engaging in notch 114. To unlock the cover, the handles are rotated in the opposite direction, i.e., the clockwise direction, to pivot bars 109 about pivots 110 to release rods 112 from engagement in notches 114. There is also an interlock provided between the locking arm and the hydraulic pressure mechanism which permits actuation of the hydraulic cylinders 56 only when the locking mechanism locks the second and first frames one to the other.

When service is required, the pivoted frame 26 is unlocked from fixed frame 12 by rotating handle 116. The interlock between the lock 117 and the hydraulic system opens to prevent hydraulic actuation when unlocked. The pneumatic air cylinders 36 are then actuated to pivot the second frame 26 about the pivot shaft between the print engine open and closed positions illustrated schematically in FIGS. 8 and 9, respectively, and by the dashed and full-line positions of FIG. 2, respectively. It will be appreciated that in the print engine open position, substantially all of the internal parts of the print unit carried by the pivoted cover and the paper web carried by the first frame are exposed to view and affording sufficient access and room for maintenance personnel to service and/or replace component parts, clean the engine and replace or adjust the paper web. Once service has been completed, the pneumatic cylinders are actuated to return the pivoted frame to the print engine closed position. Note that the frame may be pivoted manually without using the cylinders if desired. In the print engine closed position, the locking mechanism 117 is activated to lock the pivoted frame to the fixed base frame. Once locked, the hydraulic system is enabled by the interlock.

It will be appreciated that, in the locked position, the image cylinder is spaced from and not in contact with the impression cylinder. That is, the nip between the two cylinders defines a space therebetween, for example, on the order of ¼ inch. Note the full line illustration of the image cylinder 24 spaced from the impression cylinder 22 in FIG. 11. Thus, final nip engagement between the image cylinder and impression cylinder is provided by actuation of the hydraulic cylinders 56 which linearly displace the print unit 50 relative to third frame 40 in the direction toward the impression cylinder 22. This enables fewer parts on the print engine for final engagement and disengagement of the paper. It also gives a lower mass of parts needed for quick disengagement should a web debris and splice sensor unit be employed. Also, easier control of the force between the image cylinder and impression cylinder is obtained. Once engaged, the print mechanism operates similarly as a conventional ion deposition printer.

To service the print engine, the hydraulic system is shut down and the locking mechanism 117 is opened. Upon deactuation of the hydraulic system, springs 82 linearly displace the print unit 50 away from the impression cylinder and toward the third frame 40, opening the nip between the image cylinder and impression cylinder. The pivotal frame may then be pivoted back to open the print engine.

Two further advantages of the print engine hereof reside in the orthogonal relation between the impression cylinder and the paper transport and the capability of locking the impression cylinder in a fixed position when disengaging the print engine to avoid changing the tension on the paper. This is significant because, to effect proper toner fixing, the image and impression cylinders must be skewed relative to one another. By selecting the image cylinder for skewing, the impression cylinder may be orthogonally fixed relative to the paper web transport system. This substantially avoids web handling problems, such as bagging and wrinkling, as the web moves through the print engine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A print engine comprising:

a first fixed frame;

a rotatable impression cylinder carried by said fixed frame for carrying a medium for receiving print and defining a rotational axis extending in a transverse direction;

a second frame carried by said first frame for pivotal movement about an axis extending in said transverse direction and between print engine open and closed positions;

a third frame carried by said second frame for pivotal movement therewith and for movement in said transverse direction;

means for moving said third frame relative to said first and second frames in said transverse direction;

a print unit carried by said third frame for pivotal and transverse movement therewith and for movement relative thereto in a direction generally normal to said transverse direction, said print unit including an image cylinder carried for movement therewith in said transverse and normal directions, said image cylinder defining an open nip with said impression cylinder when said second frame lies in said print engine closed position; and means for moving said image cylinder in said generally normal direction to close the nip between said image cylinder and said impression cylinder when said second frame lies in said print engine closed position.

2. A print engine according to claim 1 including means for moving said image cylinder from said closed nip position to said open nip position when said second frame lies in said print engine closed position.

3. A print engine according to claim 1 including means for releasably locking said second frame in said print engine closed position.

4. A print engine according to claim 1 wherein said means for moving said image cylinder includes at least one fluid actuated cylinder carried by said second frame.

5. A print engine according to claim 1 wherein said image cylinder moving means moves said image cylinder in a linear direction toward said impression cylinder when said second frame lies in said print engine closed position.

6. A print engine according to claim 5 wherein said fluid actuated means includes a plurality of hydraulically actuated cylinders.

7. A print engine according to claim 1 including means for displacing said impression cylinder in said transverse direction.

8. A print engine according to claim 7 including means for synchronizing the movement of said impression cylinder and said image cylinder in said transverse direction.

9. A print engine according to claim 1 including means for moving said image cylinder from said closed nip position to said open nip position when said second frame lies in said print engine closed position, and means for releasably locking said second frame in said print engine closed position.

10. A print engine according to claim 1 wherein said means for moving said image cylinder includes at least one fluid actuated cylinder carried by said second frame for moving said image cylinder linearly in a direction toward said impression cylinder when said second frame lies in said print engine closed position.

11. A print engine according to claim 10 including means for displacing said impression cylinder in said transverse direction, said displacing means including means for synchronizing the transverse movement of said impression cylinder and said image cylinder in said transverse direction.

12. A print engine according to claim 1 including means carried by said first frame and movable in a transverse direction for stabilizing said third frame in the print engine closed position, and means for synchronizing the movement of said third frame and said stabilizing means such that said stabilizing means is maintained in alignment with said third frame throughout at least a portion of its transverse movement.

13. A print engine, comprising:

a first fixed frame;

a rotatable impression cylinder carried by said first frame for carrying a medium for receiving print and defining a rotational axis extending in a transverse direction;

a frame carried for pivotal movement on said first frame;

an image cylinder carried by said pivotal frame for pivotal movement therewith between a print engine open position wherein said image cylinder is spaced from said impression cylinder to enable access within said print engine and a print engine closed position wherein said image cylinder lies closely adjacent to but spaced from said impression cylinder to define an open nip with said impression cylinder; and means carried by said pivotal frame for moving said image cylinder toward said impression cylinder to close the nip therebetween when said pivotal frame lies in said print engine closed position.

14. A print engine according to claim 13 including means for releasably locking said pivotal frame in said print engine closed position.

15. A print engine according to claim 13 wherein said means for moving said image cylinder includes at least one fluid actuated cylinder carried by said second frame.

16. A print engine according to claim 15 wherein said image cylinder moving means moves said image cylinder in a linear direction toward said impression cylinder when said second frame lies in said print engine closed position.

17. A print engine comprising:

a first fixed frame;

a rotatable impression cylinder carried by said fixed frame for carrying a medium for receiving print and defining a rotational axis extending in a transverse direction;

a second frame carried by said first frame for pivotal movement about an axis extending in said transverse direction and between print engine open and closed positions;

a third frame carried by said second frame for pivotal movement therewith and for movement in said transverse direction;

an element cooperable between said third frame and at least one of said first and second frames for moving said third frame in said transverse direction relative to said at least one frame; and a print unit carried by said third frame for pivotal and transverse movement therewith and having an image cylinder defining a nip with said impression cylinder when said second frame lies in said print engine closed position.

18. A print engine according to claim 17 including means for releasably locking said second frame and said first frame one to the other in said print engine closed position.

19. A print engine according to claim 17 including means for displacing said impression cylinder in said transverse direction.

20. A print engine according to claim 19 including means for synchronizing the transverse movement of said impression cylinder and said image cylinder in said transverse direction.

21. A print engine according to claim 17 including means carried by said first frame and movable in a transverse direction for stabilizing said third frame in the print engine closed position, and means for synchronizing the movement of said third frame and said stabilizing means such that said stabilizing means is maintained in alignment with said third frame throughout at least a portion of its transverse movement.

22. A print engine comprising:

a first fixed frame;

a rotatable impression cylinder carried by said fixed frame for carrying a medium for receiving print and defining a first rotational axis extending in a transverse direction;

a second frame carried by said first frame for pivotal movement about a second axis extending in said transverse direction and between print engine open and closed positions;

a print unit carried by said second frame for pivotal movement therewith and including an image cylinder carried thereby for rotational movement about a third rotational axis extending in said transverse direction and spaced from said first and second rotational axes; and a driving element carried by said first frame and a driven element carried by said second frame and means interconnecting said driving element and said driven element for rotating said image cylinder about said third axis, said driving element and said driven element being located on said first frame and said second frame, respectively, and said interconnecting means maintaining a driving relation therebetween when said second frame lies in each said print engine open and closed positions.

23. A print engine according to claim 22 wherein said driving element includes a pulley carried by said first frame for rotation about said second axis, said driven element including a pulley carried by said second frame for rotation about said third axis, said interconnecting means including a belt extending between said pulleys.

24. A print engine comprising:

a first fixed frame;

a rotatable impression cylinder carried by said fixed frame for carrying a medium for receiving print and defining a first rotational roller axis extending in a transverse direction;

a second frame carried by said first frame for pivotal movement about a second axis extending in said transverse direction and between print engine open and closed positions;

a third frame carried by said second frame for pivotal movement therewith and for movement in said transverse direction;

an image cylinder carried by said third frame for pivotal movement therewith and for linear movement relative thereto in a direction generally parallel to said transverse direction, said image cylinder being rotatable about a third rotational axis extending in said transverse direction;

means rotatably coincident with said second axis for driving said image cylinder about said third axis; and means carried by said first frame and engageable with said third frame for moving said third frame in said transverse direction.

25. A print engine according to claim 24 including means mounting said impression cylinder for linear movement relative to said first frame in said transverse direction and including means for synchronizing the transverse movement of said impression cylinder and said image cylinder in said transverse direction.

26. A print engine according to claim 24 including means carried by said first frame and movable in a transverse direction for stabilizing said third frame in the print engine closed position, and means for synchronizing the movement of said third frame and said stabilizing means such that said stabilizing means is maintained in alignment with said third frame throughout at least a portion of its transverse movement.

27. A print engine according to claim 24 wherein said rotatably coincident means includes a drive shaft coincident with said second axis, said moving means including an ear carried by said drive shaft for translational and non-rotatably movement therealong and coupled to said third frame and means for translating said ear along said drive shaft for moving said third frame in said transverse direction.

* * * * *